United States Patent [19]

Price et al.

[11] Patent Number: 4,548,140

[45] Date of Patent: Oct. 22, 1985

[54] NEEDLE PLATE FINGER COMB FOR TUFTING MACHINES

[75] Inventors: Herbert B. Price; Ian Slattery, both of Hixson, Tenn.

[73] Assignee: Spencer Wright Industries, Inc., Chattanooga, Tenn.

[21] Appl. No.: 633,706

[22] Filed: Jul. 23, 1984

[51] Int. Cl.[4] ..... D05C 15/00

[52] U.S. Cl. ..... 112/79 R

[58] Field of Search ..... 112/79 R, 79 A, 79 FF

[56] References Cited

U.S. PATENT DOCUMENTS 3,492,956 2/1970 Webb ..... 112/79 R

FOREIGN PATENT DOCUMENTS 6612390 9/1967 Netherlands ..... 112/79 R
1584476 2/1981 United Kingdom ..... 112/79 R
1589289 5/1981 United Kingdom ..... 112/79 R

*Primary Examiner*—Ronald Feldbaum
*Attorney, Agent, or Firm*—Alan Ruderman

[57] ABSTRACT

A mounting comb for a tufting machine for mounting the needle plate fingers so that the fingers may be readily replaced without requiring substantial cutting of base material. The combs have a base member including a plurality of slots for receiving respective elongated fingers, and at least one securing member releasably assembled to the base member for positively locking the fingers in the comb. In two embodiments the base member has a shallow elongated channel and one securing member is positionable within the channel to clamp the fingers into the slots. In one of these embodiments the securing member is a thin elongated bar, while in the other the securing member is a portion of a base plate upon which the comb is mounted. In another embodiment the base portion and the securing portion each have spaced lands including finger receiving slots through each of the lands. The members are securable together with the lands of one of the members disposed between the lands of the other members, and a pair of cooperating wall portions of the respective members clamp the fingers therebetween. In the preferred embodiment the base member has a channel in which a plurality of securing members in the form of threaded fasteners are received, each fastener engaging a pair of fingers.

19 Claims, 14 Drawing Figures

NEEDLE PLATE FINGER COMB FOR TUFTING MACHINES

BACKGROUND OF THE INVENTION

This invention relates to tufting machines and more particularly to a needle plate finger mounting comb for mounting readily removable base material support fingers in a tufting machine.

In conventional tufting machines an oscillating looper or hook cooperates with a reciprocating needle to form loops at the reverse side of the backing material penetrated by the needle. The backing material is supported by fingers extending forwardly from a needle plate and the needles pass between the fingers. Until recently it has been common practice to secure the fingers into a slotted elongated needle plate which in turn was secured to the tufting machine bed plate, the fingers being secured as by swaging into the slots in the needle plate as illustrated in U.S. Pat. Nos. 2,976,829 and 3,064,600. If a finger was broken or damaged so as to require replacement, the needle plate had to be removed from the machine and the broken finger had to be hammered or chiselled out of the needle plate. To permit removal of the needle plate, since the base material is supported thereon, a large section of base material had to be cut away thereby subsequently requiring substantial mending and increasing the risk that the tufted fabric produced would be classified as a "second."

Although a later development suffered from the same deficiency of requiring a large portion of base material to be cut to remove the fingers, the fingers were not swaged into the slots so that the time for replacing broken fingers was reduced. In this development the fingers were inserted into slots in a first plate which was fixed to the bed plate and a second plate was secured to the first plate by screws to hold the needles therein. The first and second plates were removed as a unit, screws holding the plates together were removed and the plates disassembled from each other. However, although the fingers could be readily changed at the machine station, when the plates were disassembled the fingers tended to merely fall out and most if not all had to be reassembled into the plates.

Subsequently, with the development of modular components by the assignee of the present invention, small modular finger assemblies were developed in which the fingers were fixedly molded into a small body member and the body members were attached to a base plate secured to the bed plate. Although small modular members can be used to thereby avoid cutting a substantial amount of base material to permit removal of a module from the base plate, the fingers are fixed in the module and can't be replaced near the machine. Another module is substituted and the old module is either discarded or remanufactured to replace the broken fingers.

Thus, although it is desirable to provide finger mounting constructions which permit changing a broken finger at or near the machine station and providing means which only require a slight cut in the base material to remove the broken fingers, until the present invention no such construction has been developed.

SUMMARY OF THE INVENTION

Consequently, it is a primary object of the present invention to provide a needle plate finger mounting construction for tufting machines which readily permits replacement of damaged fingers.

It is another object of the present invention to provide needle plate finger modules for a tufting machine which may be removed from the tufting machine without requiring substantial cutting of the base material, the modules being in the form of a comb in which the fingers may be readily replaced at the tufting machines.

It is a further object of the present invention to provide a modular needle plate finger comb for a tufting machine having a plurality of slots each for receiving a finger, the comb comprising at least two members readily connected together for entrapping the fingers in the slots and being readily separated to permit replacement of at least selective fingers.

It is a still further object of the present invention to provide a modular needle plate finger comb for a tufting machine having a plurality of slots each for receiving a finger, the comb having means for entrapping each pair of adjacent fingers within respective slots and readily permitting replacement of selective fingers.

Accordingly, the present invention provides a comb having a base portion including a plurality of slots each for receiving a respective elongated finger, a free end of each finger extending beyond the base portion, the base portion and the other or tail end of each finger having or carrying cooperating elements for disposition of the free ends of the fingers at the same extension beyond the base member, and securing means releasably assembled to the base portion for positively locking the fingers in the comb when connected to the base portion and for permitting replacement of the fingers when disassembled from the base portion.

In two forms of the invention the base portion of the comb has a shallow elongated channel preferably of a dovetail configuration, and the securing means of the comb comprises an elongated strip of material positionable within the channel to clamp the fingers down within the slots. In one of these forms the strip of material is a thin elongated bar, while in the other form the strip is a portion of the base plate upon which the comb is disposed. Another aspect of the invention is to provide the base portion of the comb with an elongated groove substantially normal to the finger receiving slots, and the tail end of the fingers with a bend at the disposition of the wall forming the leading edge of the groove, and have the tail end of the fingers abut the rear wall of the groove to frictionally tension the fingers in the slots to prevent the fingers from moving in their longitudinal directions. Moreover, this construction will prevent the fingers from falling out when the securing portion is removed.

In another form of the invention the fingers are disposed in slots formed in spaced apart lands formed on the base portion of the comb, and the securing means comprises a member having spaced apart slotted lands projecting from a surface, the lands of the securing means being received intermediate the lands of the base portion and the slots in one member being complementary to those of the other member so that each finger is secured in a slot formed in all the lands. Another aspect of this embodiment is the provision of a bend in the tail end of the fingers to engage and clamp between cooperating wall surfaces of the clamping portion and the base portion. Preferably the cooperating wall surfaces are inclined which securely locks the clamping portion and the fingers to the base portion.

In the preferred form of the invention the base portion has an elongated channel and the securing means comprises a plurality of threaded fasteners disposed within the channel, each fastener being received between a pair of fingers, the fingers being disposed above the trough or floor of the channel and each fastener having a head abutting the respective pair of fingers, and an elongated groove is formed in the base of the comb rearwardly of the channel substantially normal to the finger receiving slots, the groove receiving an abutment member against which the tail end of the fingers abut. In this form of the invention the tail end of the fingers need not have a bend.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODMENT

Figure 1:
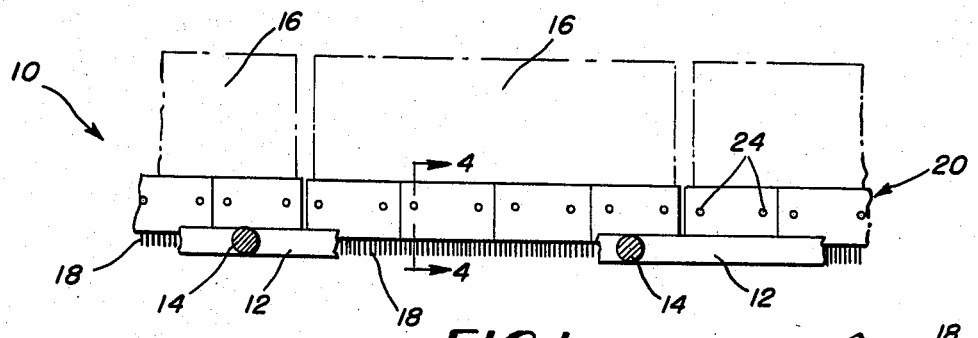
FIG. 1 is a fragmentary horizontal cross-sectional view taken through a portion of the head of a tufting machine looking onto the bed, the bed incorporating a needle plate having needle plate finger combs constructed in accordance with a first embodiment incorporating the principles of the present invention.

Referring to the drawings and particularly FIG. 1 a portion of a tufting machine 10 is illustrated including a fragment of the needle bar 12 which is adapted to be recipicrocably driven vertically by means of push rods 14, (only two of which are illustrated) for penetrating a multiplicity of needles through a backing material moving across a needle plate 16 as is notoriously well known in the art for inserting loops of yarn through the backing. The needles pass between adjacent pairs of needle plate fingers 18 which are also known in the art as reed fingers. The needle plate fingers 18 generally, in the prior art, are secured to the needle plate by various means which precluded convenient replacement of the fingers as aforesaid, but in accordance with the principles of the present invention the fingers 18 are mounted in comb structures which overcome these difficulties of the prior art, one embodiment of such structure being illustrated generally at 20 in FIG. 1.

Figure 3:
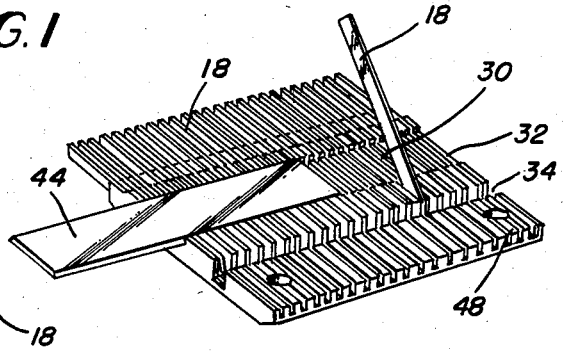
FIG. 3 is a bottom perspective view thereof with the securing plate partly removed and one finger illustrated in a partially removed position.

In the embodiment of FIG. 1 the comb structure 20 comprises a plurality of modular base members 22 preferably of a convenient length in the transverse direction of the tufting machine, the base members being mounted side-by-side and secured to the needle plate 16 by screw means 24 or the like received within counterbored holes 26 in the base 22. The upper surface of the base 22 is substantially planar and preferably includes a tappered leading edge such as 28 adjacent to where the fingers 18 project. As illustrated in FIG. 3 the underside of the base member 22 is formed with a plurality of slots 30 extending from front to rear in the direction that the fingers 18 extend. Formed transverse to the slots 30 the entire length of each base member 22 is a shallow channel 32 while an elongated groove 34 is formed spaced from the channel 32, the channel 32 being intermediate the groove 34 and the leading edge of the comb. The groove 34 is substantially the same depth as the slots 30 for reasons which will hereinafter become clear.

Figure 4:
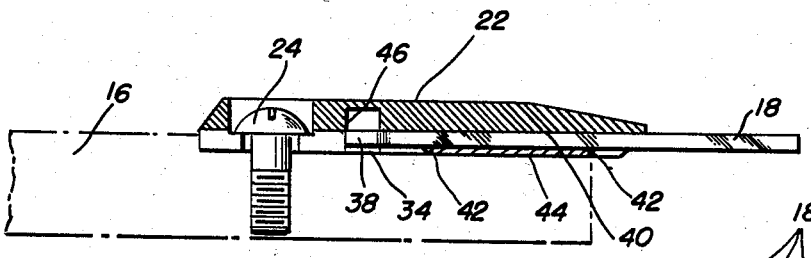
FIG. 4 is a cross-sectional view taken substantially along line 4—4 of FIG. 1.
Figure 5:
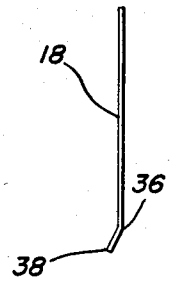
FIG. 5 is an elevational view of one needle plate finger used in the first embodiment.

The fingers 18 comprise a strip of spring metal which, as illustrated in FIGS. 4 and 5, has a rectangular configuration. The thickness of the fingers as illustrated in FIG. 5 is very narrow and depends upon the gauge of the tufting machine, while the width of the fingers as illustrated in FIG. 4 is substantially greater than the thickness. Moreover, as illustrated in FIG. 5 the tail end of the fingers has a bend 36 adjacent the rear end. The length of the fingers between the bend 36 and the tail end, defined as the bent portion 38 is substantially equal to the front to rear width of the groove 34.

As illustrated in FIG. 4 the depth of the slots 30 is slightly deeper than the width of the fingers so one surface of the fingers 18 may be positioned within the slots and bottomed against the wall 40 of the base 22 while having the opposite surface of the fingers coextensive with the recessed wall of the channel 32. Preferably, the side walls of the channel 32 are undercut at 42 so as to form a dovetail or the like, and a substantially rectangular securing member 44 is slidably disposed in the channel. The member 44 may have dovetailed edges and be of a width such that its longitudinal edges are securely disposed in the undercut portion while the thickness of the securing member 44 is such that its outer surface is coextensive with the bottom surface of the base member as it clamps the fingers into the slots. The wall 40 of the base member 22 forms a reference surface for the fingers which are securely clamped therein by the securing member 44.

To position the fingers within the respective slots 30 the bent portion 38 of each finger is disposed in the groove adjacent the desired slot 30 and the remainder of the finger is positioned within the slot. The tail end of the bent portion 38 acts against the remote wall 46 of the groove 34 as a spring and frictionally tensions the finger in the respective slot and prevents the fingers from inadvertently falling from the slots when the securing member 44 is removed. Moreover, the frictional tension of the bent portion 38 precludes the fingers from slidably moving in the longitudinal direction of the slot which a straight finger would do even if it were possible to make every finger the exact size so as to be clamped with equal force by the securing member 44. Since the tail end of the finger does not extend beyond the rear wall of the groove 34, the slots in the surface 48 beyond the groove serve no function, but are formed by the manufacturing process when the slots 30 are cut in the surfaces between the groove 34 and the front edge of the base member.

Figure 2:
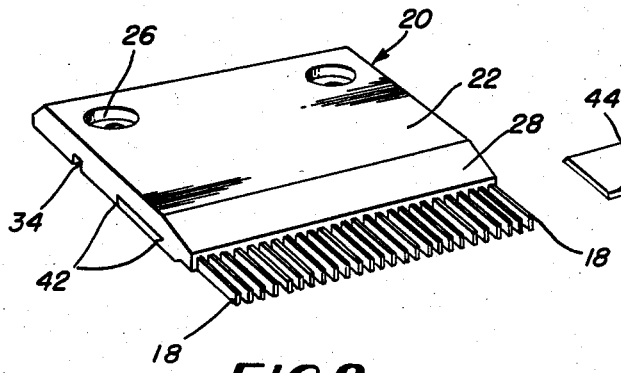
FIG. 2 is a top front perspective view of one needle plate finger comb illustrated in FIG. 1.
Figure 6:
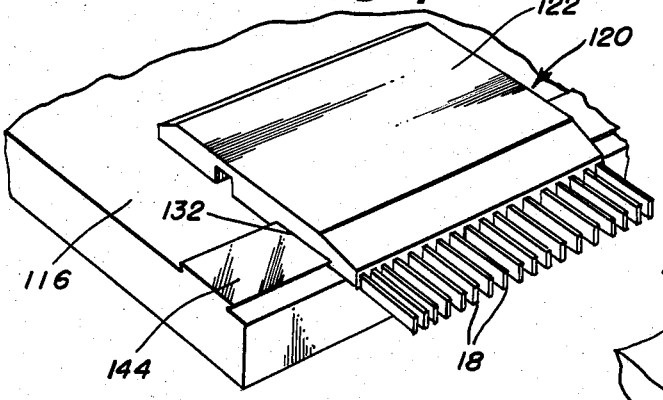
FIG. 6 is a top front perspective view similar to FIG. 2 but of a second embodiment of the invention.

In the embodiment illustrated in FIG. 6, the comb 120 is substantially similar to that illustrated in FIGS. 2 through 4, but rather than there being a separate securing member such as member 44, in this embodiment the needle plate 116, or an auxiliary plate on which the base member 122 is mounted, includes an upstanding land 144 which may either be of a rectangular cross-sectional configuration or have dovetail edges receivable within the channel 132 of the base member 122. Thus, in this embodiment whether the land is in the form of dovetail edges or rectangular edges positioned within the dovetail of the channel there is no need to use fastening screws to attach the base member to the plate 116 except for the end members since each will slide transversely in seriatim onto the land. The fingers are positionable within the slots exactly as in the first embodiment.

Figure 8:
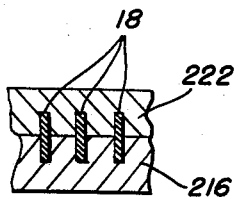
FIG. 8 is a cross-sectional view taken substantially along line 8—8 of FIG. 7.
Figure 7:
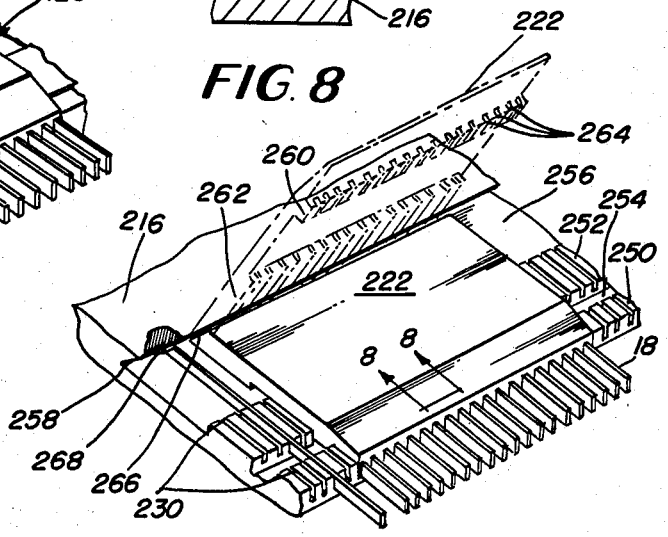
FIG. 7 is a view similar to FIG. 6 but of a third embodiment.

In the embodiment illustrated in FIGS. 7 and 8 the needle plate or an auxiliary plate 216 has a plurality of slots 230 formed therein on lands 250, 252 spaced apart by a groove 254 of a depth substantially equal to that of the slots 230. The land 250 is adjacent the front edge of the plate 216 where the free ends of the fingers extend. At the rear of the land 230 another groove 256 is formed which has its rear wall or edge 258 formed with a dovetail undercut. Positioned on the plate 216 is another member 222 which on its underside includes a pair of spaced apart downwardly extending lands 260, 262 respectively. Another plurality of slots 264 are formed in the lands 260, 262, the spacing between adjacent slots 264 being the same as that between adjacent slots 230, i.e., equal to the gauge of the tufting machine. The land 260 is of a width and shape substantially equal to the groove 254 so as to be positionable therein while the land 262 may be either substantially equal to or narrower in width to the groove 256. The rear wall or edge 266 of the member 222 has a tapered surface substantially conforming to that of the wall 258 of the plate 216.

As illustrated, the fingers 218 have a bend 268 formed at a compound angle at the rear thereof which is positionable in abutting relationship with the wall 258 when the fingers are disposed within the slots 230. Thus, the member 222 may be positioned on the plate with the rear edge 266 abutting the bend 268 of the fingers to clamp the end of the fingers in the respective slots, and the member 222 is thereafter lowered in pivotable fashion about the rear wall surfaces 258, 266 with the bends 268 of the fingers clamped therebetween. The lands 262 and 260 enter the respective grooves 256 and 254 with the slots 264 receiving the exposed portions of the fingers 18. Thus, the fingers are clamped down into the slots 230 and locked in place by the sandwiching action of the bend between the surfaces 258 and 256.

It may be mentioned that although the member 222 acts as a securing member in the embodiment of FIGS. 7 and 8, it may also be considered as a base member in the same sense as the member 22 in the first embodiment and the member 122 in FIG. 6. Although this last embodiment may be more expensive to manufacture it has the advantage of not requiring any securing means, and permits any member 222 to be pried up to replace broken fingers at the machine.

In the embodiment illustrated in FIGS. 9 through 13, which is the preferred mode of the invention, the comb comprises a plurality of base members 322 similar to the base member 22 of the first embodiment and attachable to the needle plate 16 by the screw means 24, illustrated in FIG. 1, received within counterbored holes 326. The upper surface of the base member 322 includes a tapered leading edge 328 as in the other embodiments, but here a plurality of finger receiving slots 330 are formed in the top surface of the base member 322 and the tapered portion 328. Formed transverse to the slots 30 the entire length of each base member 322 is a relatively deep channel 332 while a narrow groove 334 is formed spaced from the channel 332, the channel 332 being intermediate the groove 334 and the leading edge of the base member.

The fingers 318 used with this embodiment are conventional needle plate fingers having straight shanks or tail ends 319. Thus, to provide a stop means in the base for abutting the tail end of the fingers so that the free ends of the fingers are disposed at the same extension beyond the leading edge of the base member, an abutment member 336 in the form of a strip or rod of spring metal is received in the groove 334, the member 336 being press fit into the groove and acts as a wall against which the tail end 319 of the fingers abut. The depth of the groove 334 need only be deep enough so that the member 336 will be at a level for engaging at least a portion of the fingers, the member being disposed so that its upper edge is recessed below the upper surface of the base member 322. The provision of the groove 334 and the abutment 336 permits the slots to be cut in this embodiment, as in the other embodiments by a large diameter circular saw blade and yet still have a wall or abutment means against which the tail end of the fingers may stop.

Figure 11:
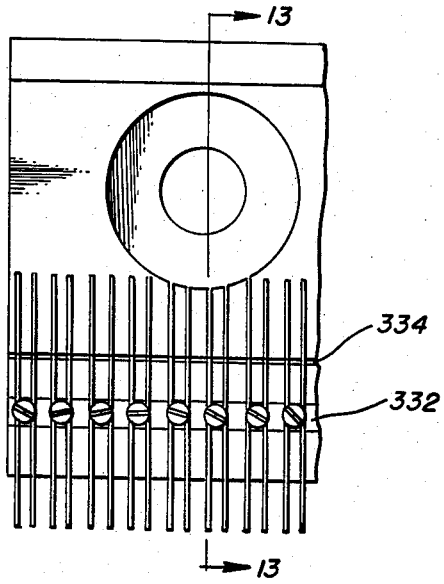
FIG. 11 is a fragmentary top plan view of a portion of the comb illustrated in FIG. 9.
Figure 12:
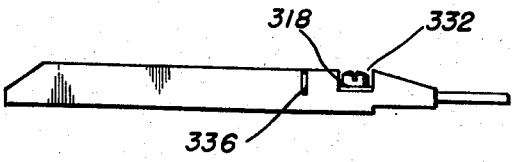
FIG. 12 is an end elevational view of the comb.
Figure 13:
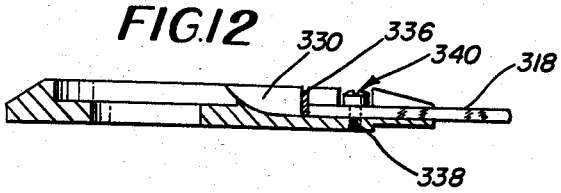
FIG. 13 is a cross-sectional view taken substantially along line 13—13 of FIG. 11.

To securely hold and clamp the fingers within the respective slot 330 the base member 332 has a tapered hole 338 formed intermediate each pair of slots 330 and a threaded fastener 340 is threadely received within each hole. Each fastener 340 has a head portion 342 large enough to span the slots on either side thereon so as to engage the upper surfaces of the fingers 318 in those slots as best illustrated in FIG. 11. To provide that the heads 342 of the fasteners engage the upper surfaces of the fingers 318, the depth of the channel 332 is such that the fingers 318 when seated in the bottom of their respective slots 330 extend above the floor of the channel, as best illustrated in FIG. 12. Thus, to replace a broken needle plate finger the fastener 340 securing it is loosened, the finger removed, another finger inserted and the fastener is secured—a process that may be performed in a matter of seconds at the machine thereby increasing the efficiency of the machine.

Figure 9:
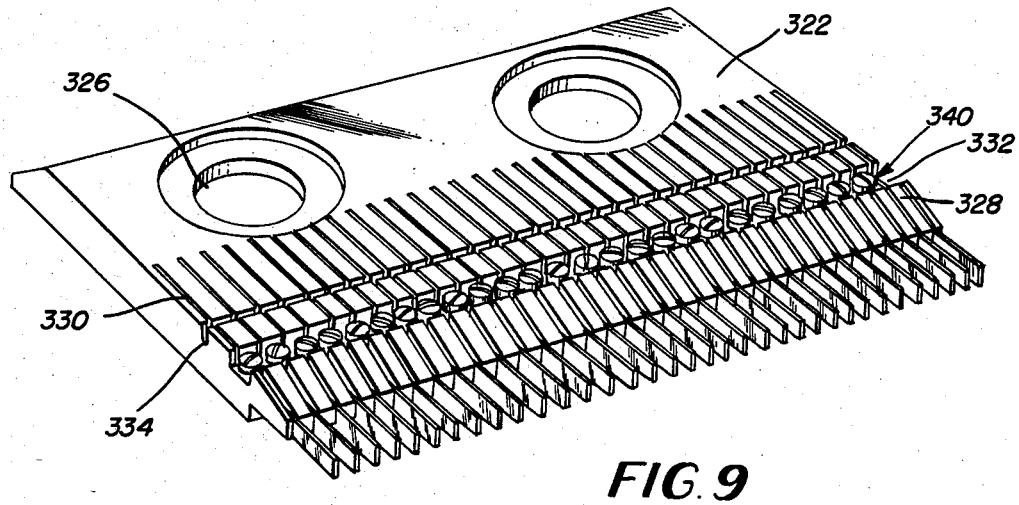
FIG. 9 is a top front perspective view of a needle plate finger comb similar to FIG. 2, but of a fourth and preferred embodiment of the invention.
Figure 10:
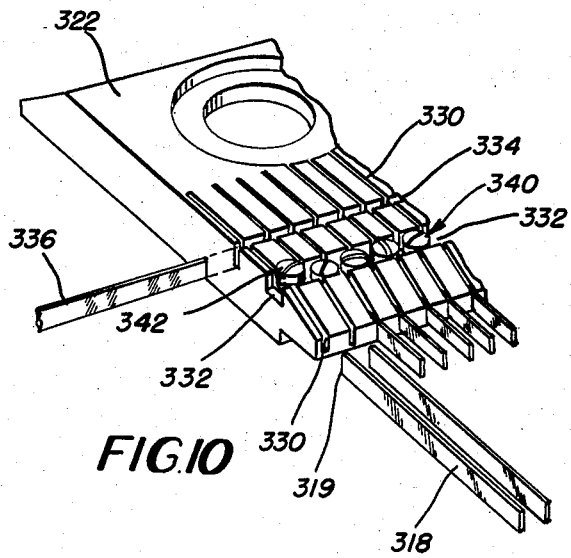
FIG. 10 is a fragmentary top front perspective view of a portion of the needle plate finger comb illustrated in FIG. 9 with parts thereof dissassembled from the base member.
Figure 14:
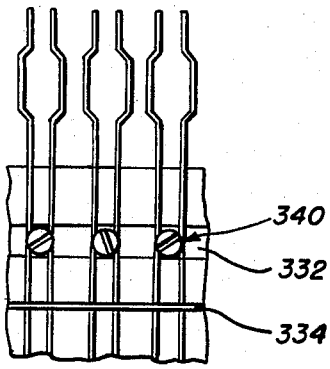
FIG. 14 is a fragmentary top plan view similar to FIG. 11, but illustrating the adaptability of the comb with the needle plate fingers of other forms such as those used in conjunction with staggered needle tufting machines.

The invention illustrated in the embodiment of FIG. 9 can be universally applied to tufting machines having a varied sort of conventional needle plate fingers. For example, as illustrated in FIG. 14, the invention may be applied to staggered needle tufting machines having needle plate fingers such as illustrated in U.S. Pat. No. 3,064,600, as it may to any of the known needle plate finger configurations such as the so called "I-Y" configuration.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A mounting comb for a tufting machine for mounting a plurality of elongated needle plate fingers, each finger having a first end defined as a free end and a second end defined as a tail end, said comb comprising a base member including a plurality of slots formed therein, each slot adapted for receiving a respective finger, stop means in said base member for abutting the tail end of said fingers to permit fingers of appropriate lengths to overhang the base by a desired amount, means defining an elongated channel in the base member extending substantially normal to the axis of elongation of said slots intermediate the free ends of said fingers and said stop means, and securing means disposed in said channel and assembled to said base member for releasably holding said fingers in the slots.

2. A mounting comb for a tufting machine as recited in claim 1, wherein said fingers have an offset bend at the tail end, said bend being at an angle less than normal to the axis of elongation of said fingers so as to frictionally tension the fingers to preclude withdrawal of each finger from the respective slot.

3. A mounting comb for a tufting machine as recited in claim 2, wherein said channel has a depth less than said slots for forming a surface substantially coextensive with an edge portion of said fingers, and said securing means is a planar securing member slidably received in said channel.

4. A mounting comb for a tufting machine as recited in claim 3, wherein said securing member comprises an elongated bar.

5. A mounting comb for a tufting machine as recited in claim 4, wherein said bar comprises a substantially rectangular relatively thin strip of material substantially conforming to the cross-sectional configuration of said channel.

6. A mounting comb for a tufting machine as recited in claim 5, wherein said channel includes spaced undercut walls for defining a dovetail and said bar includes elongated edges received in abutment with said undercut walls.

7. A mounting comb for a tufting machine as recited in claim 5, wherein said bar is formed integral with the support plate, and said base member is fastened to said support plate.

8. A mounting comb for a tufting machine as recited in claim 7, wherein said channel includes spacead undercut walls for defining a dovetail and said bar includes elongated edges received in abutment with said undercut walls.

9. A mounting comb for a tufting machine as recited in claim 1, wherein said slots are formed in spaced upstanding lands extending transverse to the axis of elongation of said slots, said channel being formed between said lands, and wherein said securing member comprises a substantially planar member securely received in said channel.

10. A mounting comb for a tufting machine as recited in claim 9, wherein said securing member comprises an elongated bar.

11. A mounting comb for a tufting machine as recited in claim 10, wherein said bar comprises a substantially rectangular relatively thin strip of material substantially conforming to the cross-sectional configuration of said channel.

12. A mounting comb for a tufting machine as recited in claim 10, wherein said bar is formed integral with a support plate, and said base member is fastened to said support plate.

13. A mounting comb for a tufting machine as recited in claim 12, wherein said channel includes spaced undercut walls for defining a dovetail and said bar includes elongated edges received in abutment with said undercut walls.

14. A mounting comb for a tufting machine as recited in claim 1, wherein said stop means comprises a wall formed in said base substantially normal to the axis of elongation of said slots, and said slots are formed in spaced upstanding lands extending transverse to the axis of elongation of said slots, said channel being formed intermediate said wall and one of said lands, said securing means comprising a securing member including spaced downwardly extending lands, said lands of said securing member having finger receiving slots and said lands being spaced apart for receipt intermediate the lands of said base member and intermediate said one land and said wall, whereby said fingers are received within respective slots of said base member and said securing member.

15. A mounting comb for a tufting machine as recited in claim 14, wherein said securing member includes a wall conforming to the shape of the wall of said base member for clamping the tail ends of said fingers therebetween.

16. A mounting comb for a tufting machine as recited in claim 15, wherein said walls are inclined relatively to the axes of said slots.

17. A mounting comb for a tufting machine as recited in claim 1, wherein said stop means comprises a groove formed in said base member substantially normal to the axis of elongation of said slots, and a strip of material positioned in said groove for abutting the tail end of said fingers.

18. A mounting comb for a tufting machine as recited in claim 17, wherein said channel has a depth less than said slots so that said fingers project above the floor of said channel when said fingers are disposed in the bottom of said slots, and said securing means acts on the edge of the fingers which project above said floor.

19. A mounting comb for a tufting machine as recited in claim 18, wherein said securing means comprises a plurality of threaded members, each threaded member being threadedly received in the floor of said channel intermediate a respective pair of slots, and each threaded member having a head abutting the edge of the fingers in said pair of slots which project above said floor.

* * * * *